US006538376B1

(12) United States Patent
Kimura et al.

(10) Patent No.: US 6,538,376 B1
(45) Date of Patent: Mar. 25, 2003

(54) PHOTOMULTIPLIER TUBE

(75) Inventors: Suenori Kimura, Hamamatsu (JP); Masuo Ito, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 180 days.

(21) Appl. No.: 09/694,267

(22) Filed: Oct. 24, 2000

Related U.S. Application Data

(63) Continuation-in-part of application No. PCT/JP99/00161, filed on Jan. 19, 1999.

(51) Int. Cl.[7] ..... H01J 43/20
(52) U.S. Cl. ..... 313/532; 313/528
(58) Field of Search ..... 313/532, 533, 313/534, 535, 536, 377, 379, 384, 387, 530, 528, 103 R, 103 CM, 105 R, 105 CM, 541, 531

(56) References Cited

U.S. PATENT DOCUMENTS

| | | | | | |
|---|---|---|---|---|---|
| 4,143,291 | A | * | 3/1979 | Morales | 313/103 |
| 4,311,939 | A | * | 1/1982 | Faulnker et al. | 313/95 |
| 4,649,268 | A | * | 3/1987 | Persyk | 250/207 |
| 4,980,604 | A | * | 12/1990 | L'Hermite | 313/533 |
| 5,481,158 | A | * | 1/1996 | Kato et al. | 313/533 |
| 5,616,987 | A | * | 4/1997 | Ohmura et al. | 313/533 |
| 5,936,348 | A | * | 8/1999 | Shimoi et al. | 313/533 |

FOREIGN PATENT DOCUMENTS

| | | |
|---|---|---|
| JP | 59-221959 | 12/1984 |
| JP | 59-226454 | 12/1984 |
| JP | 3-81257 | 12/1991 |
| JP | 4-345741 | 12/1992 |
| JP | 5-82076 | 4/1993 |
| JP | 9-45275 | 2/1997 |

* cited by examiner

*Primary Examiner*—Ashok Patel
(74) *Attorney, Agent, or Firm*—Morgan, Lewis & Bockius LLP

(57) ABSTRACT

In this photomultiplier tube 1, light incident on a light-receiving faceplate 3 is converted into photoelectrons by a photosensitive surface 3*a*, and the photoelectrons strike a dynode 4 to emit many secondary electrons. The secondary electrons are then collected by a mesh-like anode 5. Since the anode 5 is disposed to be parallel to the photosensitive surface 3*a*, the photoelectrons emerging from the photosensitive surface 3*a* can easily pass through a mesh portion 5*a*, and many photoelectrons can be made to strike the dynode 4. As the number of photoelectrons incident on the dynode 4 increases, the number of secondary electrons from the dynode 4 increases. This improves the gain characteristics of the photomultiplier tube 1. Since a secondary electron emission surface 4*a* of the dynode 4 is tilted with respect to the anode 5, photoelectrons having passed through the anode 5 obliquely strike the secondary electron emission surface 4*a* of the dynode 4.

6 Claims, 12 Drawing Sheets

PHOTOMULTIPLIER TUBE

RELATED APPLICATIONS

The present application is a continuation-in-part application of PCT application No. PCT/JP99/00161 filed on Jan. 19, 1999.

BACKGROUND OF THE INVENTION

1. Field of the Invention

The present invention relates to a photomultiplier tube which can operate even in a ferromagnetic field and, more particularly, to a photomultiplier tube used in the field of high-energy physics.

2. Related Background Art

A conventional technique in such a field is disclosed in Japanese Patent Publication No. 3-81257. The photomultiplier tube described in this reference is used in a ferromagnetic field. This photomultiplier tube converts light into photoelectrons by using a photocathode (photosensitive surface) formed on the transparent light-receiving faceplate of a sealed vessel. Photoelectrons emitted from the photosensitive surface strike a dynode in the form of a circular truncated cone first, and then are captured by an anode formed from a metal grating having a transmittance of 80 to 90%. As a consequence, predetermined photodetection can be performed even in a ferromagnetic field.

The above conventional photomultiplier tube, however, suffers the following problem. The anode used by this photomultiplier tube must be worked into the form of a circular truncated cone in accordance with the shape of the dynode in the form of a circular truncated cone. It is very difficult to work an anode in such a shape by using a very thin mesh plate. The formation of an anode in the form of a circular truncated cone will increase the process cost. If a thicker mesh plate is used to facilitate working an anode, photoelectrons emitted from the photosensitive surface have the difficulty in passing through the anode. As a result, photoelectrons are captured by the anode before they strike the dynode, resulting in a deterioration in gain.

Note that photomultiplier tubes for use in a ferromagnetic field are disclosed in, for example, Japanese Patent Laid-Open Nos. 4-345741, 5-82076, and 9-45275.

The present invention has been made to solve the above problems, and has as its object to provide a photomultiplier tube designed to decrease a process cost while improving gain characteristics.

SUMMARY OF THE INVENTION

A photomultiplier tube including a photosensitive surface for emitting photoelectrons in accordance with light incident on a light-receiving faceplate, a dynode for emitting secondary electrons upon receiving the photoelectrons emitted from the photosensitive surface, and a mesh-like anode for collecting the secondary electrons is characterized in that the anode is disposed to be parallel to the photosensitive surface, and the dynode has a secondary electron emission surface tilted with respect to the anode.

In this photomultiplier tube, light incident on a light-receiving faceplate is converted into photoelectrons by a photosensitive surface, and the photoelectrons strike a dynode to emit many secondary electrons. The secondary electrons are then collected by a mesh-like anode. Since the anode is disposed to be parallel to the photosensitive surface, the photoelectrons emerging from the photosensitive surface can easily pass through a mesh portion, and many photoelectrons can be made to strike the dynode. As the number of photoelectrons incident on the dynode increases, the number of secondary electrons from the dynode increases. This improves the gain characteristics of the photomultiplier tube. In addition, since the anode is formed to have a flat shape conforming to the shape of the photosensitive surface, the mesh-like anode can be easily molded. A secondary electron emission surface of the dynode is tilted with respect to the anode, photoelectrons having passed through the anode obliquely strike the secondary electron emission surface of the dynode. As a consequence, the number of secondary electrons emitted can be increased. This also improves the gain characteristics of the photomultiplier tube.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of a photomultiplier tube according to the present invention will be described in detail below with reference to the accompanying drawings.

Figure 1:
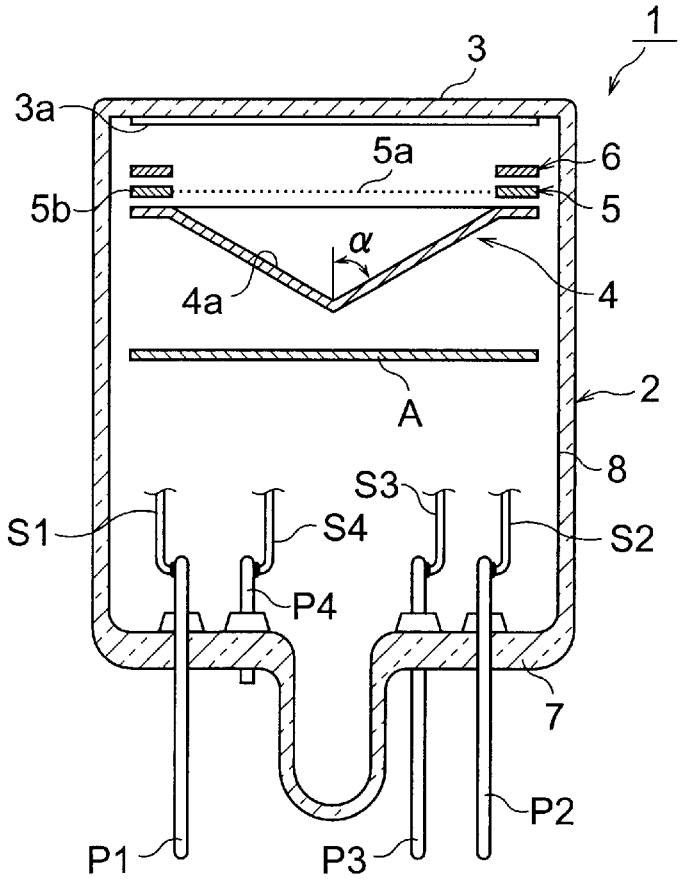
FIG. 1 is a sectional view showing the first embodiment of a photomultiplier tube according to the present invention.

A photomultiplier tube 1 shown in FIG. 1 can operate even in a ferromagnetic field (more than 1 Tesla), and is used in the field of high-energy physics. The photomultiplier tube 1 has a glass sealed vessel 2. A transparent light-receiving faceplate 3 is integrally formed with a cylindrical sidewall 8 on an upper portion of the sealed vessel 2. A photosensitive surface 3*a* for converting light into photoelectrons is formed on the lower surface of the light-receiving faceplate 3 by vapor deposition.

The sealed vessel 2 contains a dynode 4 for emitting secondary electrons toward the photosensitive surface 3*a* side upon reception of photoelectrons emitted from the photosensitive surface 3*a*. The dynode 4 is fixed on the distal end of a stem pin P1 through a connection pin S1 to oppose the photosensitive surface 3*a*. In addition, an anode 5 in the form of a mesh, which collects secondary electrons generated by the dynode 4, is disposed between the photosensitive surface 3*a* and the dynode 4. The anode 5 is fixed to the distal end of a stem pin P2 through a connection pin S2. A predetermined potential is applied to the anode 5 through the stem pin P2.

Figure 2:
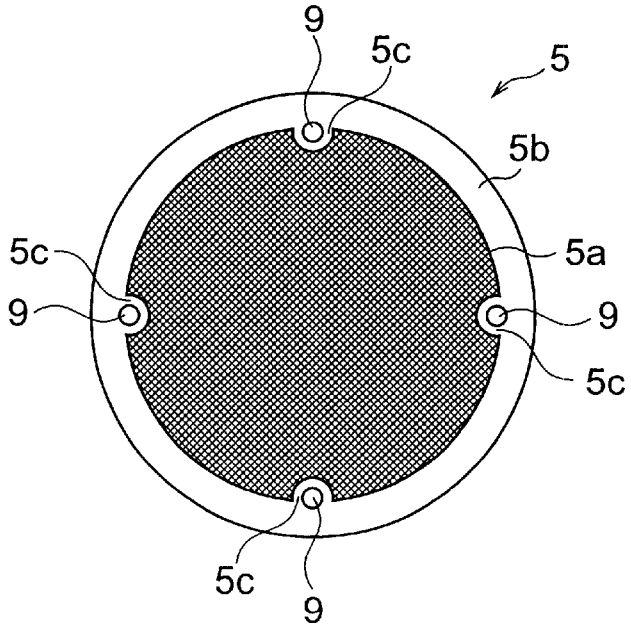
FIG. 2 is a plan view showing an anode applied to the photomultiplier tube in FIG. 1.

The anode 5 also has a circular mesh portion 5*a* surrounded by a ring-like outer frame 5*b* (see FIG. 2). This mesh portion 5*a* is made of a copper fine-mesh net with 1000 mesh or more and a thickness of 4 $\mu$m or less, and is spread within the outer frame 5*b* to be parallel to the photosensitive surface 3*a*. The anode 5 has four pin through holes 9. Each pin through hole 9 is formed in an ear portion 5*c* inwardly protruding from the outer frame 5*a*.

A ring-like converging electrode plate 6 is disposed between the anode 5 and the photosensitive surface 3*a*. This converging electrode plate 6 is fixed on three connection pins S4 fixed on three auxiliary stem pins P4 and one connection pin S3 fixed on one stem pin P3, and mounted on the sealed vessel 2 through a leaf spring (not shown). Each of the connection pins S3 and S4 is welded to the converging electrode plate 6 so as to extend through a corresponding one of the pin through holes 9 of the anode 5. A predetermined potential is applied to the converging electrode plate 6 through the stem pin P3. Note that since the converging electrode plate 6 is electrically connected to the photosensitive surface 3*a*, the converging electrode plate 6 and photosensitive surface 3*a* are set at the same potential.

The above dynode 4 is made of a thin stainless steel plate having a thickness of about 0.4 mm, and has a V-shaped cross-section that protrudes toward the stem 7 of the sealed vessel 2. The dynode 4 is formed into a conical shape by pressing to attain a reduction in process cost. In addition, a V-shaped secondary electron emission surface 4*a* is formed on the upper surface of the dynode 4 located on the photosensitive surface 3*a* side. This secondary electron emission surface 4*a* is formed on the upper surface of the dynode 4 by vapor deposition of antimony. The secondary electron emission surface 4*a* is formed to have a surface with a predetermined tilt angle $\alpha$ (e.g., 60°) with respect to the anode 5. That is, the secondary electron emission surface 4*a* is formed as a conical surface with a vertex angle of 120°.

A heat shield plate A is disposed below the dynode 4 in the sealed vessel 2. The dynode 4 serves to protect the dynode 4, anode 5, and the like in the sealed vessel 2 from heat generated when the glass stem 7 is welded/fixed to the glass cylindrical sidewall 8 by using a burner or the like in assembling the photomultiplier tube 1. The heat shield plate A is fixed on the connection pin S1 to be set at the same potential as that of the dynode 4.

As described above, since the anode 5 is disposed to be parallel to the photosensitive surface 3*a*, photoelectrons emitted from the photosensitive surface 3*a* can easily pass through the mesh portion 5*a* of the anode 5, thus making many photoelectrons strike the dynode 4. As the number of photoelectrons that strike the dynode 4 increases, the number of secondary electrons generated by the secondary electron emission surface 4*a* of the dynode 4 increases. This makes it possible to improve the gain characteristics of the photomultiplier tube 1.

Figure 3:
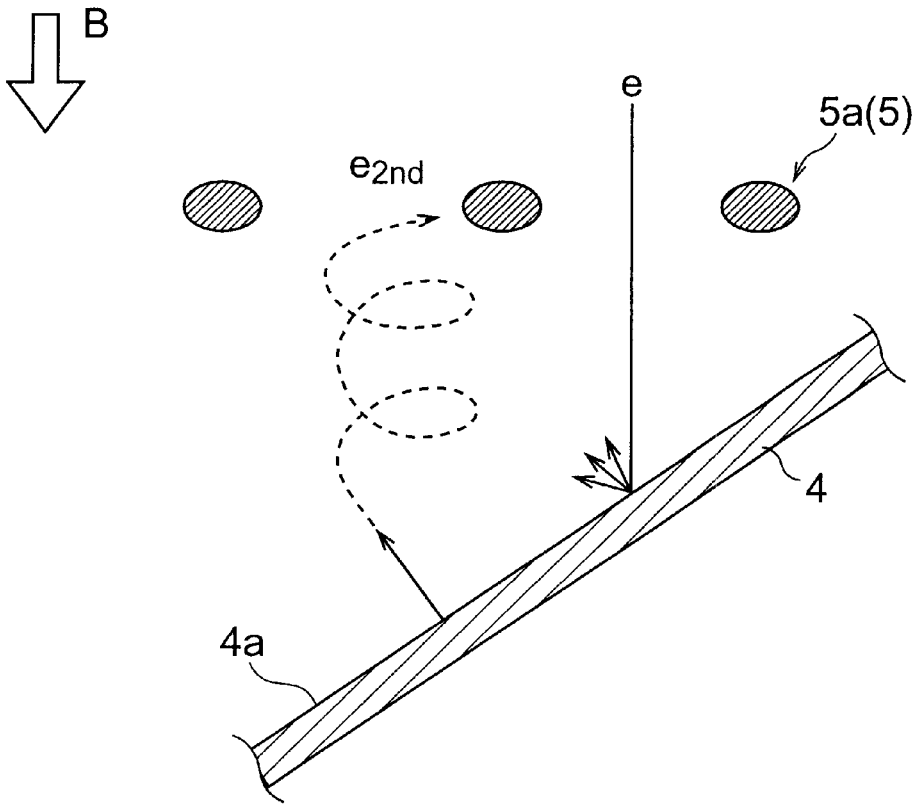
FIG. 3 is an enlarged sectional view showing a state wherein electrons are emitted from the secondary electron emission surface of a dynode.

In addition, as shown in FIG. 3, since the secondary electron emission surface 4*a* of the dynode 4 is tilted with respect to the anode 5, photoelectrons having passed through the mesh portion 5*a* of the anode 5 obliquely strike the secondary electron emission surface 4*a* of the anode 5 at a predetermined angle. As a consequence, the number of secondary electrons emitted from the secondary electron emission surface 4*a* increases. In addition, since secondary electrons undergo complicated movements (e.g., helical movement) due to the influence of a magnetic field B, the secondary electrons can be easily collected by the mesh portion 5*a* of the anode 5. This also leads to an improvement in the gain characteristics of the photomultiplier tube 1.

Figure 4:
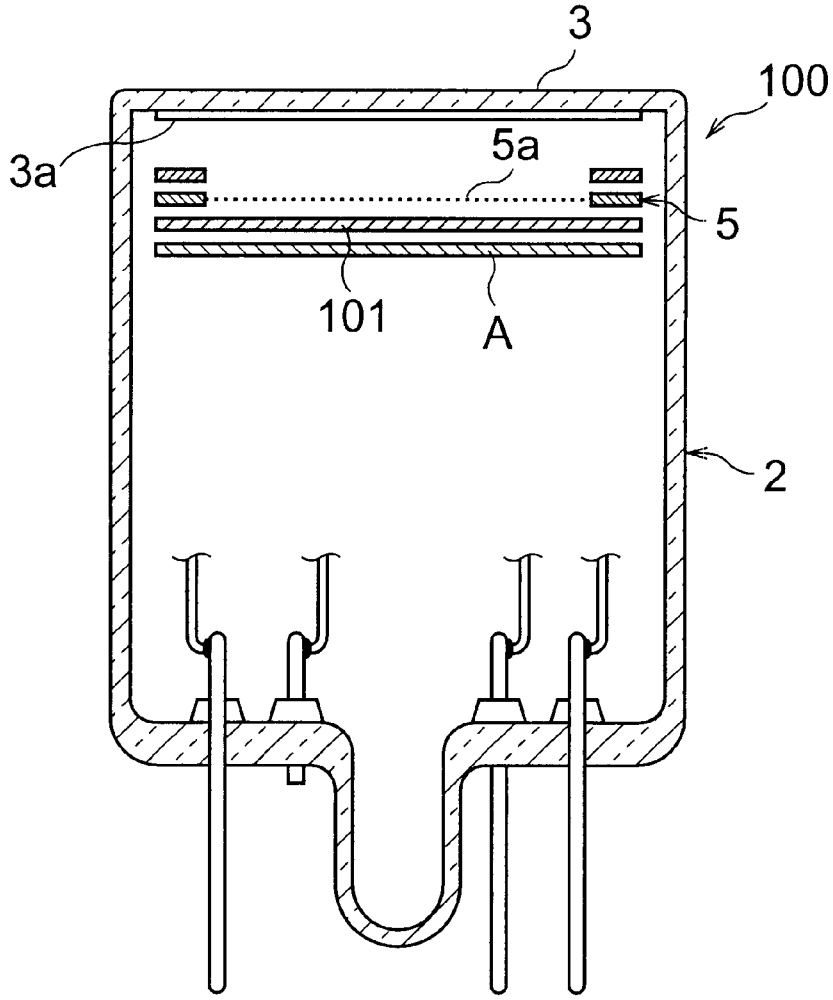
FIG. 4 is a sectional view showing a photomultiplier tube as a comparative example.

Tests were carried out to verify the effects of the photomultiplier tube 1 described above. Note that a mesh net with 2000 mesh is used for the mesh portion 5*a* in the photomultiplier tube 1. As a comparative example, a photomultiplier tube 100 shown in FIG. 4 is used. This photomultiplier tube 100 differs from the photomultiplier tube 1 in that it has a flat dynode 101.

Figure 5:
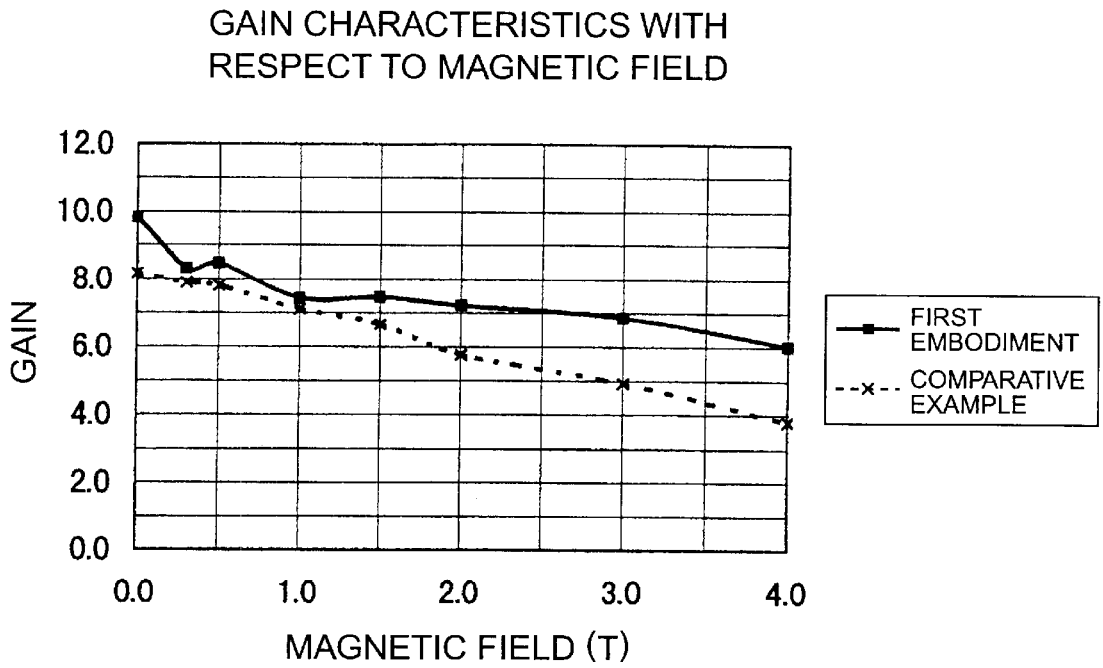
FIG. 5 is a graph showing the gain characteristics of the photomultiplier tube in FIG. 1 in a predetermined magnetic field.

As shown in FIG. 5, when the photomultiplier tubes 1 and 100 are not influenced by any magnetic field, i.e., with a magnetic field of 0 Tesla, the gain of the photomultiplier tube 100 according to the comparative example was 8.0. In contrast to this, the gain of the photomultiplier tube 1 according to the first embodiment became as high as 10.0. Obviously, the photomultiplier tube 1 exhibits a high gain owing to its unique structure even when it is not used in a magnetic field. In a ferromagnetic field of 4 Tesla, the gain of the photomultiplier tube 100 decreases to 4.0. In contrast to this, the photomultiplier tube 1 exhibits a gain of 8.0. That is, the gain of the photomultiplier tube 1 does not decrease even under the influence of a ferromagnetic field. This is because the secondary electron emission surface 4*a* of the dynode 4 is tilted with respect to the anode 5.

Figure 6:
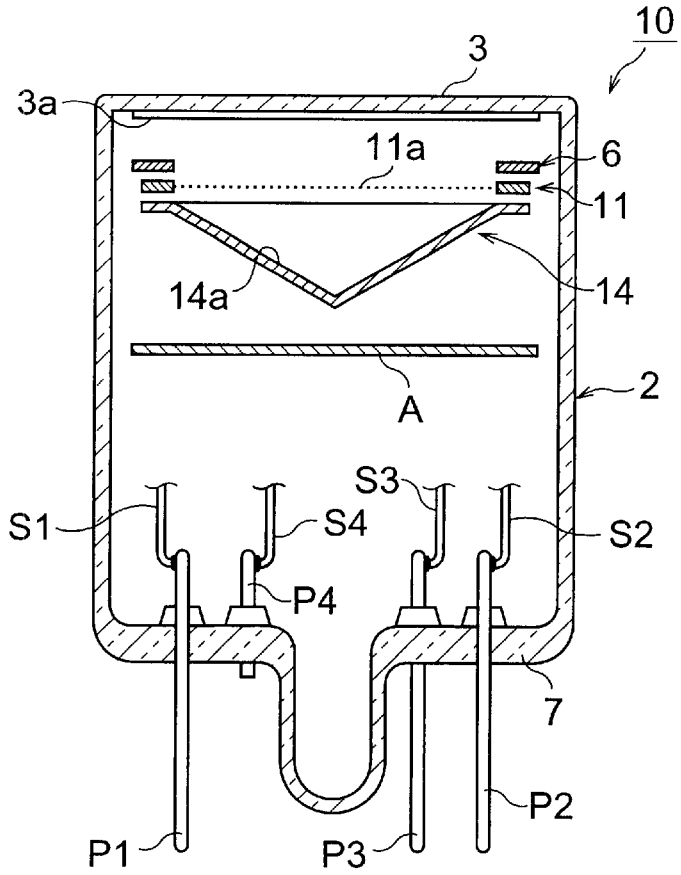
FIG. 6 is a sectional view showing the second embodiment of the photomultiplier tube according to the present invention.
Figure 7:
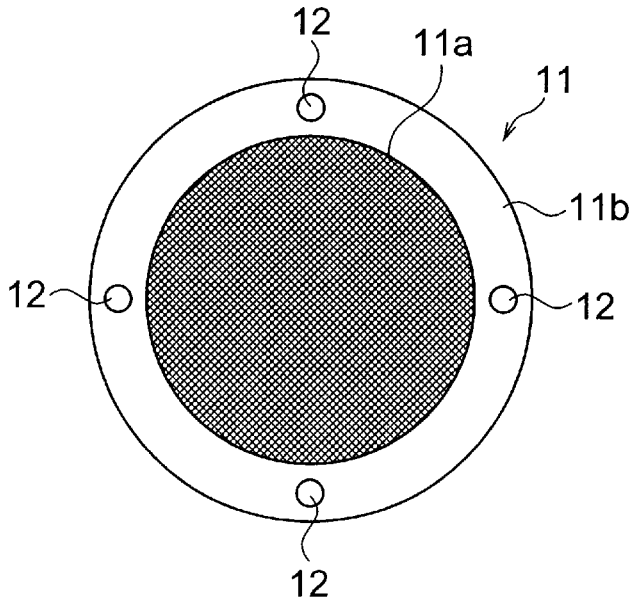
FIG. 7 is a plan view showing an anode applied to the photomultiplier tube in FIG. 6.

As shown in FIGS. 6 and 7, an anode 11 of a photomultiplier tube 10 according to the second embodiment has a rink-like outer frame 11*b* around a mesh portion 11*a* having a relatively small area. Four pin insertion holes 12 are formed in the outer frame 11*b*. A secondary electron emission surface 14*a* of a dynode 14 is formed into a conical shape in accordance with the size of the mesh portion 11*a*. This anode 11 is formed by enlarging the outer frame 11*b*. This is an effective means for preventing the anode 11 from thermally deforming.

Figure 8:
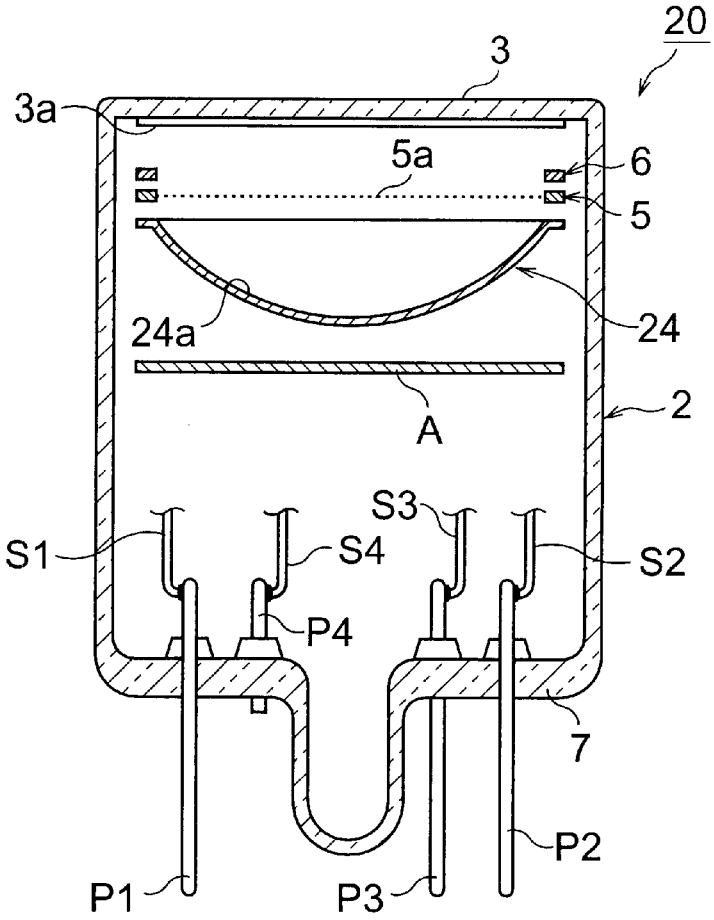
FIG. 8 is a sectional view showing the third embodiment of the photomultiplier tube according to the present invention.
Figure 9:
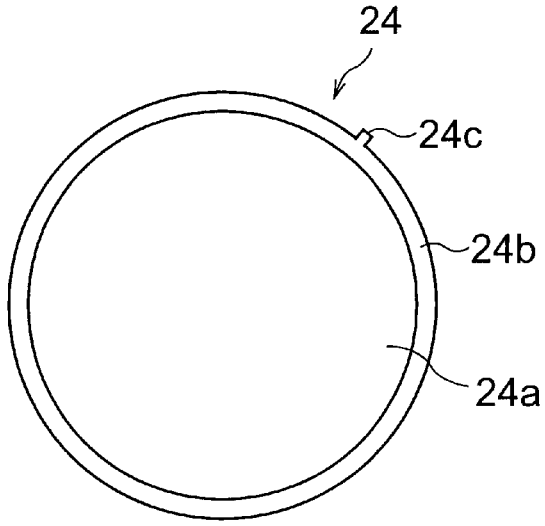
FIG. 9 is a plan view showing a dynode applied to the photomultiplier tube in FIG. 8.

As shown in FIGS. 8 and 9, a photomultiplier tube 20 according to the third embodiment includes a dynode 24 having a secondary electron emission surface 24*a* with an arcuated cross-section. This dynode 24 has a flange portion 24*b* around its circumference. An ear portion 24*c* to which a connection pin S1 is to be welded is formed on the flange portion 24*b*. As described above, since the secondary electron emission surface 24*a* is formed by a surface tilted with respect to an anode 5, photoelectrons having passed through a mesh portion 5*a* obliquely strike the secondary electron emission surface 24*a*. Therefore, the number of secondary electrons emitted from the secondary electron emission surface 24*a* can be increased, and the gain characteristics of the photomultiplier tube 20 can be improved. Furthermore, since secondary electrons undergo complicated movements (e.g., helical movement) owing to the influence of a magnetic field, secondary electrons can be easily collected by the mesh portion 5*a* of the anode 5. This also leads to an improvement in the gain characteristics of the photomultiplier tube 20.

Figure 10:
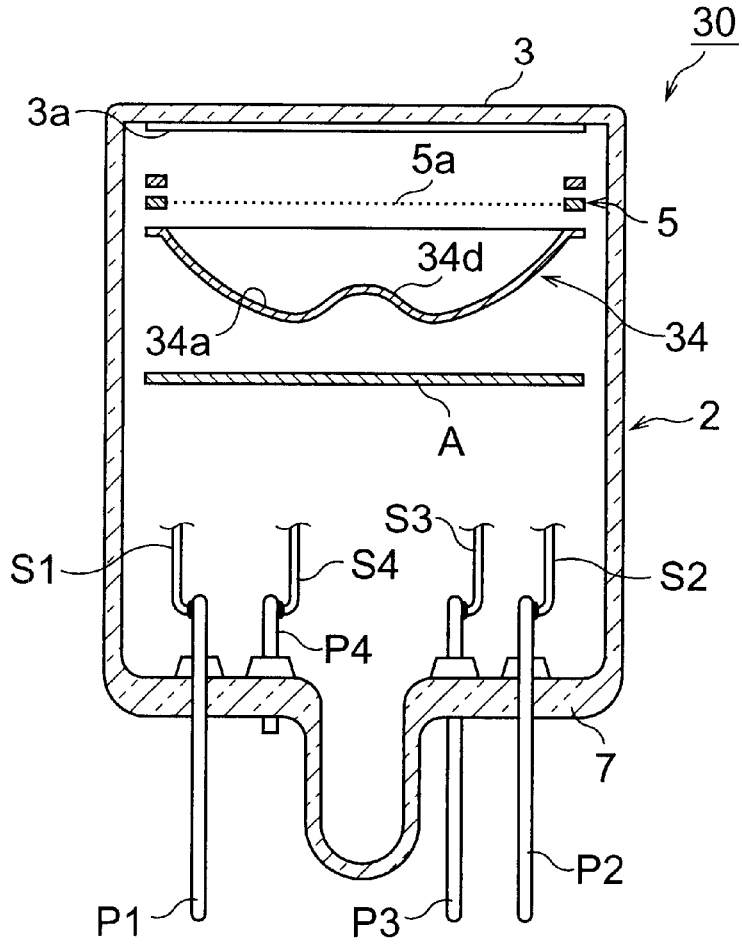
FIG. 10 is a sectional view showing the fourth embodiment of the photomultiplier tube according to the present invention.
Figure 11:
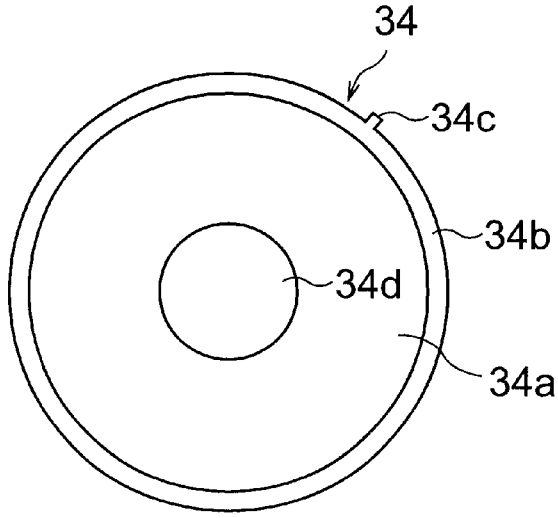
FIG. 11 is a plan view showing a dynode applied to the photomultiplier tube in FIG. 10.

As shown in FIGS. 10 and 11, a photomultiplier tube 30 according to the fourth embodiment includes a dynode 34 having a second electron emission surface 34*a* having an arcuated cross-section. A spherical projection surface 34*d* is formed at the center of the second electron emission surface 34*a* to protrude toward a mesh portion 5*a* of an anode 5. The dynode 34 has a circular flange portion 34*b* around its circumference. An ear portion 34*c* to which a connection pin S1 is to be welded is formed on the flange portion 34*b*. As described above, since the second electron emission surface 34*a* is formed by a surface tilted with respect to the anode 5, photoelectrons obliquely strike the second electron emission surface 34*a*. Therefore, the number of secondary electrons emitted from the second electron emission surface 34*a* can be increased, and the gain characteristics of the photomultiplier tube 30 can be improved. Furthermore, since secondary electrons undergo complicated movements (e.g., helical movement) owing to the influence of a magnetic field, the secondary electrons can be easily collected by the mesh portion 5*a* of the anode 5. This also leads to an improvement in the gain characteristics of the photomultiplier tube 30.

Figure 12:
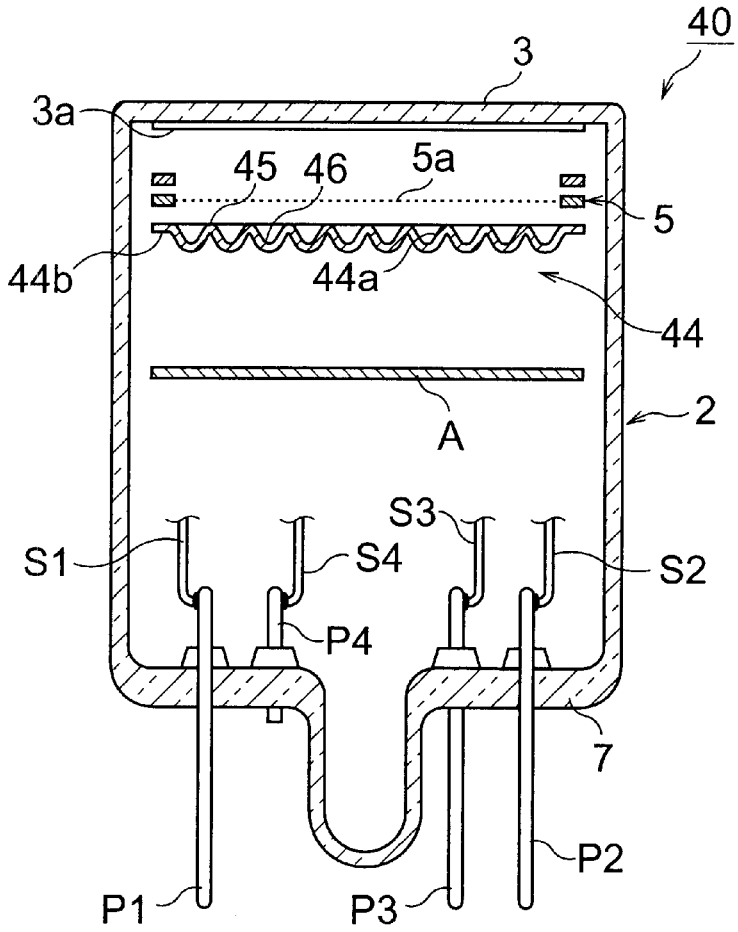
FIG. 12 is a sectional view showing the fifth embodiment of the photomultiplier tube according to the present invention.
Figure 13:
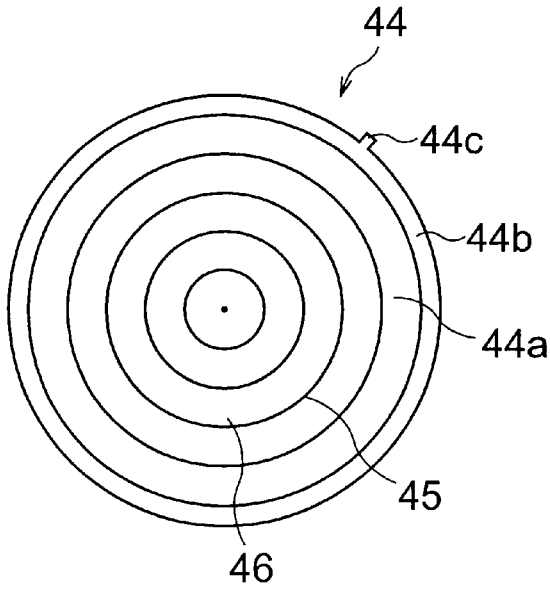
FIG. 13 is a plan view showing a dynode applied to the photomultiplier tube in FIG. 12.

As shown in FIGS. 12 and 13, a photomultiplier tube 40 according to the fifth embodiment includes a dynode 44 having a second electron emission surface 44*a* having a wavy cross-section. This second electron emission surface 44*a* is formed as a surface having ridge portions 45 and valley portions 46 sequentially arrayed in an annular form. The dynode 44 has a circular flange portion 44*b* around its circumference. An ear portion 44*c* to which a connection pin S1 is to be welded is formed on the flange portion 44*b*. As described above, since the second electron emission surface 44*a* is formed by a surface tilted with respect to the anode 5, photoelectrons having passed through a mesh portion 5*a* obliquely strike the second electron emission surface 44*a*. Therefore, the number of secondary electrons emitted from the second electron emission surface 44*a* can be increased, and the gain characteristics of the photomultiplier tube 40 can be improved. Furthermore, since secondary electrons undergo complicated movements (e.g., helical movement) owing to the influence of a magnetic field, the secondary electrons can be easily collected by the mesh portion 5*a* of the anode 5. This also leads to an improvement in the gain characteristics of the photomultiplier tube 40.

Figure 14:
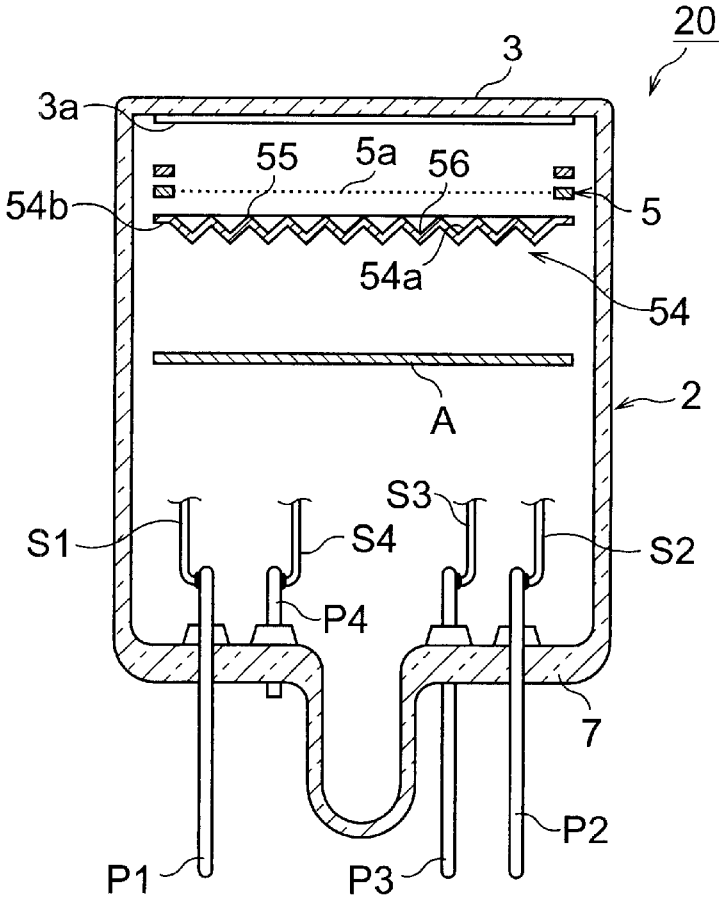
FIG. 14 is a sectional view showing the sixth embodiment of the photomultiplier tube according to the present invention.
Figure 15:
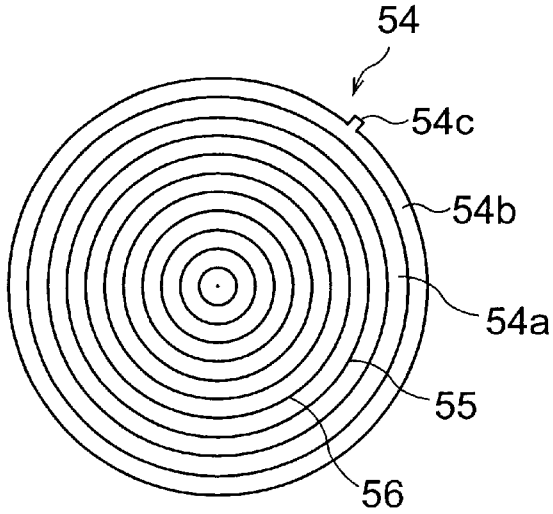
FIG. 15 is a plan view showing a dynode applied to the photomultiplier tube in FIG. 14.

As shown in FIGS. 14 and 15, a photomultiplier tube 50 according to the sixth embodiment includes a dynode 54 having a second electron emission surface 54*a* having a sawtooth cross-section. This second electron emission surface 54*a* is formed as a surface having ridge portions 55 and valley portions 56 sequentially arrayed in an annular form. The dynode 54 has a circular flange portion 54*b* around its circumference. An ear portion 54*c* to which a connection pin S1 is to be welded is formed on the flange portion 54*b*. As described above, since the second electron emission surface 54*a* is formed by a surface tilted with respect to the anode 5, photoelectrons having passed through a mesh portion 5*a* obliquely strike the second electron emission surface 54*a*. Therefore, the number of secondary electrons emitted from the second electron emission surface 54*a* can be increased, and the gain characteristics of the photomultiplier tube 50 can be improved. Furthermore, since secondary electrons undergo complicated movements (e.g., helical movement) owing to the influence of a magnetic field, the secondary electrons can be easily collected by the mesh portion 5*a* of the anode 5. This also leads to an improvement in the gain characteristics of the photomultiplier tube 50.

Figure 16:
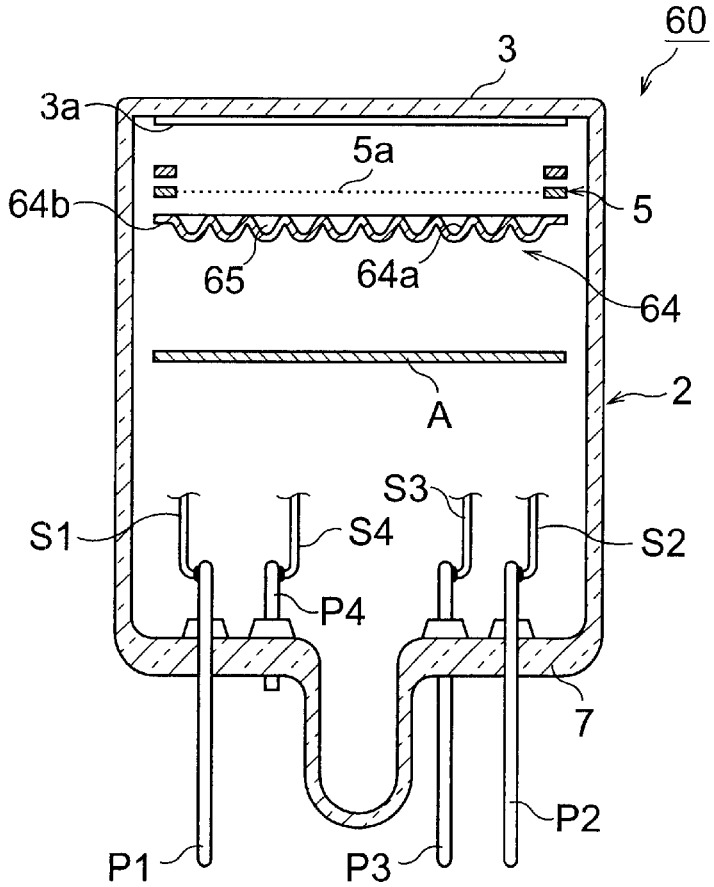
FIG. 16 is a sectional view showing the seventh embodiment of the photomultiplier tube according to the present invention.
Figure 17:
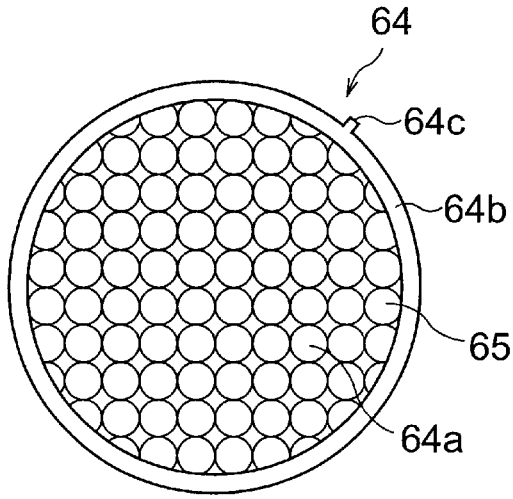
FIG. 17 is a plan view showing a dynode applied to the photomultiplier tube in FIG. 16.

As shown in FIGS. 16 and 17, a photomultiplier tube 60 according to the seventh embodiment includes a dynode 64 having a second electron emission surface 64*a* having a wavy cross-section. This second electron emission surface 64*a* is formed as a surf ace having substantially semispherical dimple portions 65 densely arrayed. The dynode 64 has a circular flange portion 64*b* around its circumference. An ear portion 64*c* to which a connection pin S1 is to be welded is formed on the flange portion 64*b*. As described above, since the second electron emission surface 64*a* is formed by a surface tilted with respect to the anode 5, photoelectrons having passed through a mesh portion 5*a* are received in the respective dimple portions 65. As a consequence, the photoelectrons obliquely strike the second electron emission surface 64*a*. Therefore, the number of secondary electrons emitted from the second electron emission surface 64*a* can be increased, and the gain characteristics of the photomultiplier tube 60 can be improved. Furthermore, since secondary electrons undergo complicated movements (e.g., helical movement) owing to the influence of a magnetic field, the secondary electrons can be easily collected by the mesh portion 5*a* of the anode 5. This also leads to an improvement in the gain characteristics of the photomultiplier tube 60.

Figure 18:
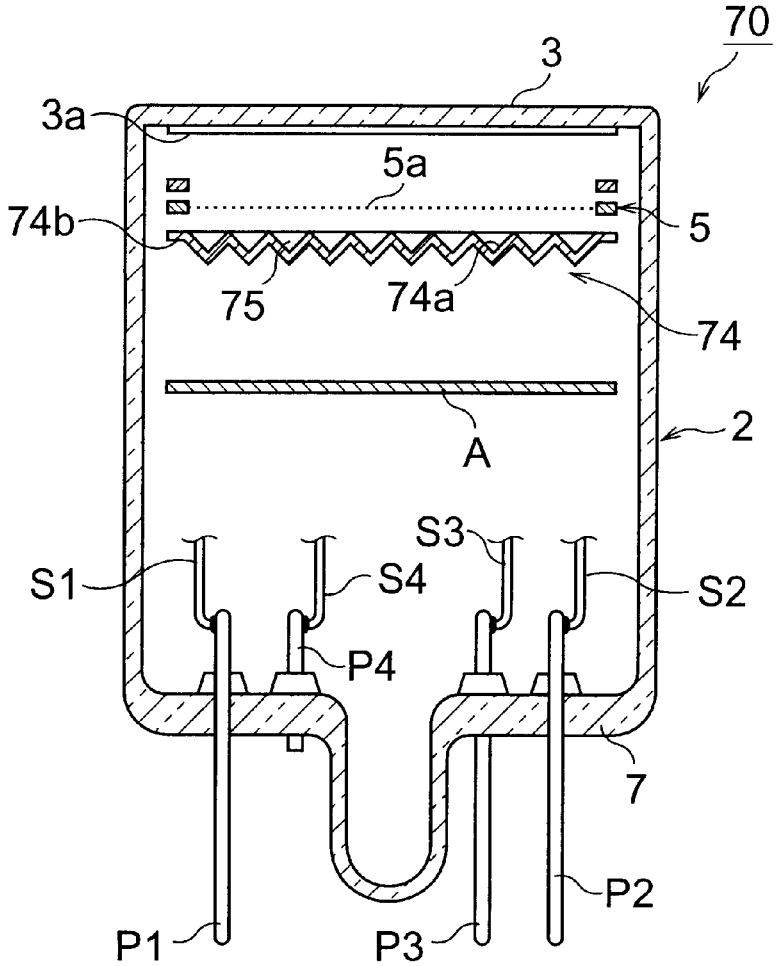
FIG. 18 is a sectional view showing the eighth embodiment of the photomultiplier tube according to the present invention.
Figure 19:
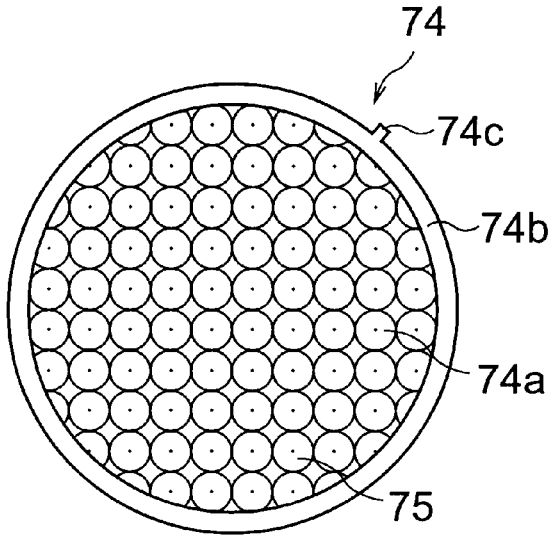
FIG. 19 is a plan view showing a dynode applied to the photomultiplier tube in FIG. 18

As shown in FIGS. 18 and 19, a photomultiplier tube 70 according to the eighth embodiment includes a dynode 74 having a second electron emission surface 74*a* having a sawtooth cross-section. This second electron emission surface 74*a* is formed as a surface having conical dimple portions 75 densely arrayed. The dynode 74 has a circular flange portion 74*b* around its circumference. A near portion 74*c* to which a connection pin S1 is to be welded is formed on the flange portion 74*b*. As described above, since the second electron emission surface 74*a* is formed by a surface tilted with respect to the anode 5, photoelectrons having passed through a mesh portion 5*a* are received in the respective dimple portions 75. As a consequence, the photoelectrons obliquely strike the second electron emission surface 74*a*. Therefore, the number of secondary electrons emitted from the second electron emission surface 74*a* can be increased, and the gain characteristics of the photomultiplier tube 70 can be improved. Furthermore, since secondary electrons undergo complicated movements (e.g., helical movement) owing to the influence of a magnetic field, the secondary electrons can be easily collected by the mesh portion 5*a* of the anode 5. This also leads to an improvement in the gain characteristics of the photomultiplier tube 70.

Figure 20:
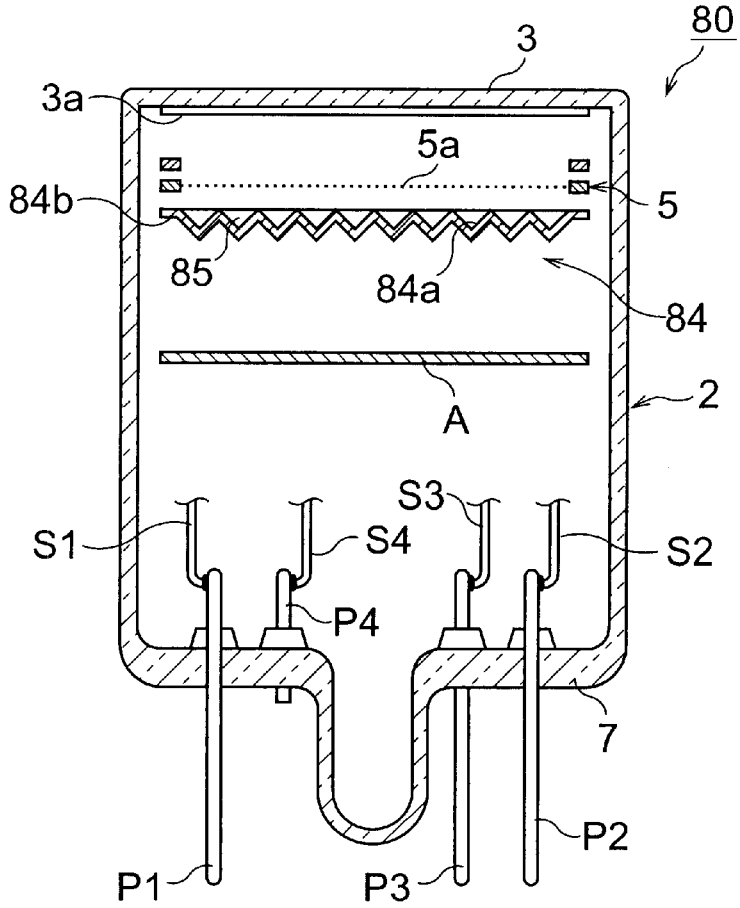
FIG. 20 is a sectional view showing the ninth embodiment of the photomultiplier tube according to the present invention.
Figure 21:
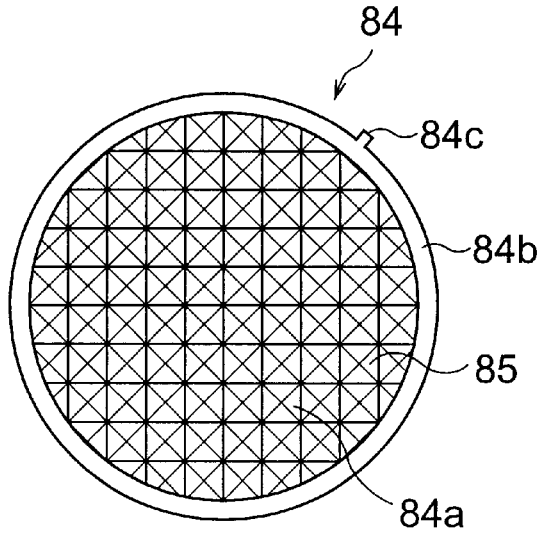
FIG. 21 is a plan view showing a dynode applied to the photomultiplier tube in FIG. 20.

As shown in FIGS. 20 and 21, a photomultiplier tube 80 according to the ninth embodiment includes a dynode 84 having a second electron emission surface 84*a* having a sawtooth cross-section. This second electron emission surface 84*a* is formed as a surface having dimple portions 85 in the form of quadrangular prisms densely arrayed. The dynode 84 has a circular flange portion 84*b* around its circumference. An ear portion 84*c* to which a connection pin S1 is to be welded is formed on the flange portion 84*b*. As described above, since the second electron emission surface 84*a* is formed by a surface tilted with respect to the anode 5, photoelectrons having passed through a mesh portion 5*a* are received in the respective dimple portions 85. As a consequence, the photoelectrons obliquely strike the second electron emission surface 84*a*. Therefore, the number of secondary electrons emitted from the second electron emission surface 84*a* can be increased, and the gain characteristics of the photomultiplier tube 80 can be improved. Furthermore, since secondary electrons undergo complicated movements (e.g.,helical movement) owing to the influence of a magnetic field, the secondary electrons can be easily collected by the mesh portion 5*a* of the anode 5. This also leads to an improvement in the gain characteristics of the photomultiplier tube 80.

The present invention is not limited to the above embodiments. For example, a central portion of the secondary electron emission surface 14*a*, which is formed to have a V-shaped cross-section, may protrude toward the mesh portion 5*a* of the anode 5 to form a projection surface having a V-shaped cross-section.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier tube comprising:

a photosensitive surface for emitting photoelectrons in accordance with light incident on a light-receiving faceplate;

a dynode for emitting secondary electrons upon receiving the photoelectrons emitted from said photosensitive surface; and a mesh-like anode disposed between said photosensitive surface and said dynode for collecting the secondary electrons, said anode being disposed to be parallel to said photosensitive surface, and said dynode having a secondary electron emission surface tilted with respect to said anode.

2. A photomultiplier tube according to claim 1, characterized in that the secondary electron emission surface of said dynode is formed to have an arcuated cross-section.

3. A photomultiplier tube according to claim 1, characterized in that the secondary electron emission surface of said dynode is formed to have a V-shaped cross-section.

4. A photomultiplier tube according to claim 1, characterized in that a central portion of the secondary electron emission surface protrudes toward said anode.

5. A photomultiplier tube according to claim 1, characterized in that the secondary electron emission surface of said dynode is formed to have a wavy cross-section.

6. A photomultiplier tube according to claim 1, characterized in that the secondary electron emission surface of said dynode is formed to have a sawtooth arcuated cross-section.

* * * * *